US007810811B2

(12) United States Patent
Suzuki et al.

(10) Patent No.: US 7,810,811 B2
(45) Date of Patent: Oct. 12, 2010

(54) SHEET CONVEYING APPARATUS AND IMAGE FORMING APPARATUS

(75) Inventors: Masato Suzuki, Mishima (JP); Kazuhiro Nishimura, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 12/053,972

(22) Filed: Mar. 24, 2008

(65) Prior Publication Data

US 2008/0237967 A1 Oct. 2, 2008

(30) Foreign Application Priority Data

Mar. 30, 2007 (JP) ..... 2007-095290

(51) Int. Cl.
*B65H 5/34* (2006.01)

(52) U.S. Cl. ..... 271/270; 271/202

(58) Field of Classification Search ..... 271/270, 271/266, 243; 399/396
See application file for complete search history.

(56) References Cited

U.S. PATENT DOCUMENTS 5,393,044 A * 2/1995 Hagihara et al. ..... 271/10.04
5,536,001 A * 7/1996 Lange et al. ..... 271/202
5,651,539 A * 7/1997 Yoshiuchi et al. ..... 271/9.09
6,345,817 B1 * 2/2002 Kakegawa et al. ..... 271/4.1
6,443,448 B1 * 9/2002 Mohr et al. ..... 271/270
6,460,687 B1 * 10/2002 Escobedo et al. ..... 198/624
6,554,216 B1 * 4/2003 Escobedo et al. ..... 242/270
6,965,742 B2 11/2005 Miyamoto et al. ..... 399/50
7,270,326 B2 * 9/2007 Mitsuya et al. ..... 271/265.04
7,280,798 B2 * 10/2007 Yuminamochi ..... 399/390
7,416,180 B2 * 8/2008 Mitsuya et al. ..... 271/122

FOREIGN PATENT DOCUMENTS

JP 05043085 A * 2/1993
JP 2002-249258 A 9/2002
JP 2002-362776 12/2002

* cited by examiner

*Primary Examiner*—Saúl J Rodríguez
*Assistant Examiner*—Luis Gonzalez
(74) *Attorney, Agent, or Firm*—Fitzpatrick, Cella, Harper & Scinto

(57) ABSTRACT

Provided is a sheet conveying apparatus including: a first sheet conveying rotary member; a second sheet conveying rotary member provided upstream of the first sheet conveying rotary member; and a third sheet conveying rotary member provided upstream of the second sheet conveying rotary member, in which: the first sheet conveying rotary member, the second sheet conveying rotary member, and the third sheet conveying rotary member can convey the same sheet at the same time; a relationship between a peripheral speed V1 of the first sheet conveying rotary member, a peripheral speed V2 of the second sheet conveying rotary member, and a peripheral speed V3 of the third sheet conveying rotary member is V3>V1>V2; and a velocity of a sheet at a portion where the sheet is ejected from the second sheet conveying rotary member is equal to or lower than the peripheral speed of the first sheet conveying rotary member.

10 Claims, 7 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus.

2. Description of the Related Art

In a sheet conveying apparatus provided to an image forming apparatus, when there is a change in sheet conveying velocity of particularly a roller nearest to a transferring portion for transferring an image onto a sheet, there is a possibility of occurring color drift, resulting in image deterioration.

In a conventional technique, in order to stabilize the sheet conveying velocity of the roller nearest to the transferring portion, sheet conveying velocities of rollers are made different from each other, thereby stabilizing the sheet conveying velocity of the roller nearest to the transferring portion (see Japanese Patent Application Laid-Open No. 2002-249258).

A structure of the conventional sheet conveying apparatus is illustrated in FIG. 7.

When a sheet S1 is conveyed by a sheet feeding roller 101 from a sheet feeding cassette 100 one at a time, the sheet S1 is conveyed successively by an intermediate conveying roller pair 102 and a registration roller pair 103. Then, the sheet S1 is attracted by an attracting roller 104 to a conveyor belt 105, and is conveyed to a transferring portion 106.

In FIG. 7, a sheet conveying velocity V1 of the attracting roller 104 and the conveyor belt 105, a sheet conveying velocity V2 of the registration roller pair 103 and a sheet conveying velocity V3 of the intermediate conveying roller pair 102 have a relationship of V1>V3>V2. A conveying guide 107 is provided between the intermediate conveying roller pair 102 and the registration roller pair 103.

In the case where the sheet conveying velocities are set in the above-mentioned manner, when the sheet S1 is nipped by the intermediate conveying roller pair 102, the sheet S1 is conveyed by the intermediate conveying roller pair 102 at the sheet conveying velocity V3. Next, when the sheet S1 reaches the registration roller pair 103, the sheet S1 is conveyed by the registration roller pair 103 at the sheet conveying velocity V2.

When the sheet S1 reaches the registration roller pair 103, a part of the sheet S1 is still conveyed by the intermediate conveying roller pair 102 at the sheet conveying velocity V3. Therefore, due to the relationship of V3>V2, the sheet S1 is bent between the intermediate conveying roller pair 102 and the registration roller pair 103, thereby generating a loop. That is, when the sheet S1 reaches the registration roller pair 103, the sheet S1 is conveyed by the registration roller pair 103 at the sheet conveying velocity V2 while forming the loop.

Next, when the sheet S1 conveyed by the registration roller pair 103 at the sheet conveying velocity V2 reaches the conveyor belt 105 via the attracting roller 104, the sheet S1 is conveyed by the attracting roller 104 and the conveyor belt 105 at the sheet conveying velocity V1 to the transferring portion 106. When the sheet S1 reaches the conveyor belt 105, a part of the sheet S1 is still conveyed by the registration roller pair 103 at the sheet conveying velocity V2. Therefore, due to the relationship of V1>V2, the sheet S1 is pulled between the attracting roller 104 and the registration roller pair 103.

When the sheet S1 is pulled as described above, because a drive portion of the registration roller pair 103 includes a one-way clutch mechanism, the registration roller pair 103 rotates along with the sheet S1. That is, when the sheet S1 is conveyed by the conveyor belt 105, the sheet conveying velocity of the registration roller pair 103 becomes the V1.

Meanwhile, when the sheet conveying velocity of the registration roller pair 103 becomes the V1, due to the relationship of V1>V3, the loop generated between the intermediate conveying roller pair 102 and the registration roller pair 103 due to the relationship of V3>V2 gradually becomes smaller. When the loop is eliminated, there is a fear of the sheet S1 being pulled.

In this manner, when the sheet S1 is pulled, because a one-way clutch mechanism is also provided to a drive portion of the intermediate conveying roller pair 102, the intermediate conveying roller pair 102 rotates integrally with the sheet S1. When the intermediate conveying roller pair 102 rotates integrally with the sheet S1, the sheet conveying velocity of the intermediate conveying roller pair 102 becomes the V1.

As descried above, when the sheet S1 is conveyed by the conveyor belt 105, the sheet conveying velocity of the intermediate conveying roller pair 102 and the registration roller pair 103 becomes the V1. As a result, the whole sheet conveying velocity is the constant sheet conveying velocity V1, thereby the sheet can be conveyed to the transferring portion 106 at the stable sheet conveying velocity V1.

In recent years, downsizing of image forming apparatuses is achieved. Accordingly, in the conventional image forming apparatus, a sheet conveying path is curved. However, in the case where the sheet conveying path is curved, when a sheet is pulled as described above so as to be stably conveyed to the transferring portion in the conventional sheet conveying apparatus, the pulled sheet is brought into contact with the conveying guide constituting the sheet conveying path in some cases.

When the sheet is brought into contact with the conveying guide, a sliding resistance of the sheet increases, thereby applying a load to conveying rollers immediately before transfer. As a result, when multiple sheets are conveyed, the conveying rollers immediately before the transfer are worn. Accordingly, the sheets cannot be continuously conveyed to the transferring portion at the stable conveying velocity.

As a separation portion for separating the sheets one by one fed from a sheet feeding cassette 100 by a sheet feeding roller 101, there may be adopted a structure in which back tension is large. In this case, when the sheet conveying velocity of the conveying rollers immediately before the sheet transfer is set to be fastest, the sheet is pulled from the separation portion when the sheet is conveyed by the conveying rollers immediately before the transfer. Therefore, a large force is required for the conveying rollers immediately before the transfer. Accordingly, occurrence of slip or wear of the rollers is promoted.

In the case where the sheets cannot be continuously conveyed to the transferring portion at the stable conveying velocity, or where the slip or the wear of the rollers is caused, color drift occurs in the transferring portion and stable image formation onto the sheets cannot be performed.

Japanese Patent Application Laid-Open No. 2002-362776 also discloses that a relationship among the conveying velocity V1 of the attracting roller 104, the conveying velocity V2 of the registration roller pair 103, and the conveying velocity V3 of the intermediate conveying roller pair 102 is V1>V3>V2. Japanese Patent Application Laid-Open No. 2002-362776 discloses that, as a reason for setting the conveying velocities to V1>V3>V2, when the conveying velocities are set to V1<V3, due to a difference in velocity between the intermediate conveying roller pair 102 and the registration roller pair 103, a loop existing upstream of the registration roller pair 103 becomes larger and larger. As a result, when a size of the loop existing upstream of the registration roller pair 19 exceeds a certain size, the loop causes the sheet to be pushed out from the registration roller pair 19. At last, the sheet is pushed out to the transferring portion, thereby causing a problem.

In order not to suffer the back tension by the separation portion with reliability, a loop can be formed in the sheet on the upstream of the rollers before the transfer. On the other hand, when a loop is formed in the sheet as described in Japanese Patent Application Laid-Open No. 2002-362776, due to stiffness of the sheet, the sheet is pushed in between the rollers before the transfer, so there is a fear of causing a problem in conveyance of the sheet.

SUMMARY OF THE INVENTION

The present invention has been made in view of the above-mentioned circumstances. The present invention provides a sheet conveying apparatus and an image forming apparatus capable of continuously conveying a sheet at a stable conveying velocity.

The present invention relates to a sheet conveying apparatus, including: a first sheet conveying rotary member; a second sheet conveying rotary member provided upstream in a sheet conveying direction of the first sheet conveying rotary member; and a third sheet conveying rotary member provided upstream in the sheet conveying direction of the second sheet conveying rotary member, in which: the first sheet conveying rotary member, the second sheet conveying rotary member, and the third sheet conveying rotary member can convey the same sheet at the same time; a relationship between peripheral speeds V1, V2, and V3 is V3>V1>V2, the V1 is a peripheral speed of the first sheet conveying rotary member, the V2 is a peripheral speed of the second sheet conveying rotary member, and the V3 is a peripheral speed of the third sheet conveying rotary member; and a velocity of a sheet at a portion where the sheet is ejected from the second sheet conveying rotary member is equal to or lower than the peripheral speed of the first sheet conveying rotary member.

In the present invention, when the sheet is conveyed by the first sheet conveying rotary member, a loop is formed in the sheet on the upstream of the first sheet conveying rotary member, so the first sheet conveying rotary member is not affected by back tension on the upstream of the loop portion. Further, pushing in of the sheet into the first sheet conveying rotary member is not caused. Accordingly, the sheet can be conveyed continuously at a stable peripheral speed.

Further features of the present invention will become apparent from the following description of exemplary embodiments with reference to the attached drawings.

DESCRIPTION OF THE EMBODIMENTS

Hereinafter, embodiments for carrying out the present invention will be described in detail with reference to the drawings.

Figure 1:
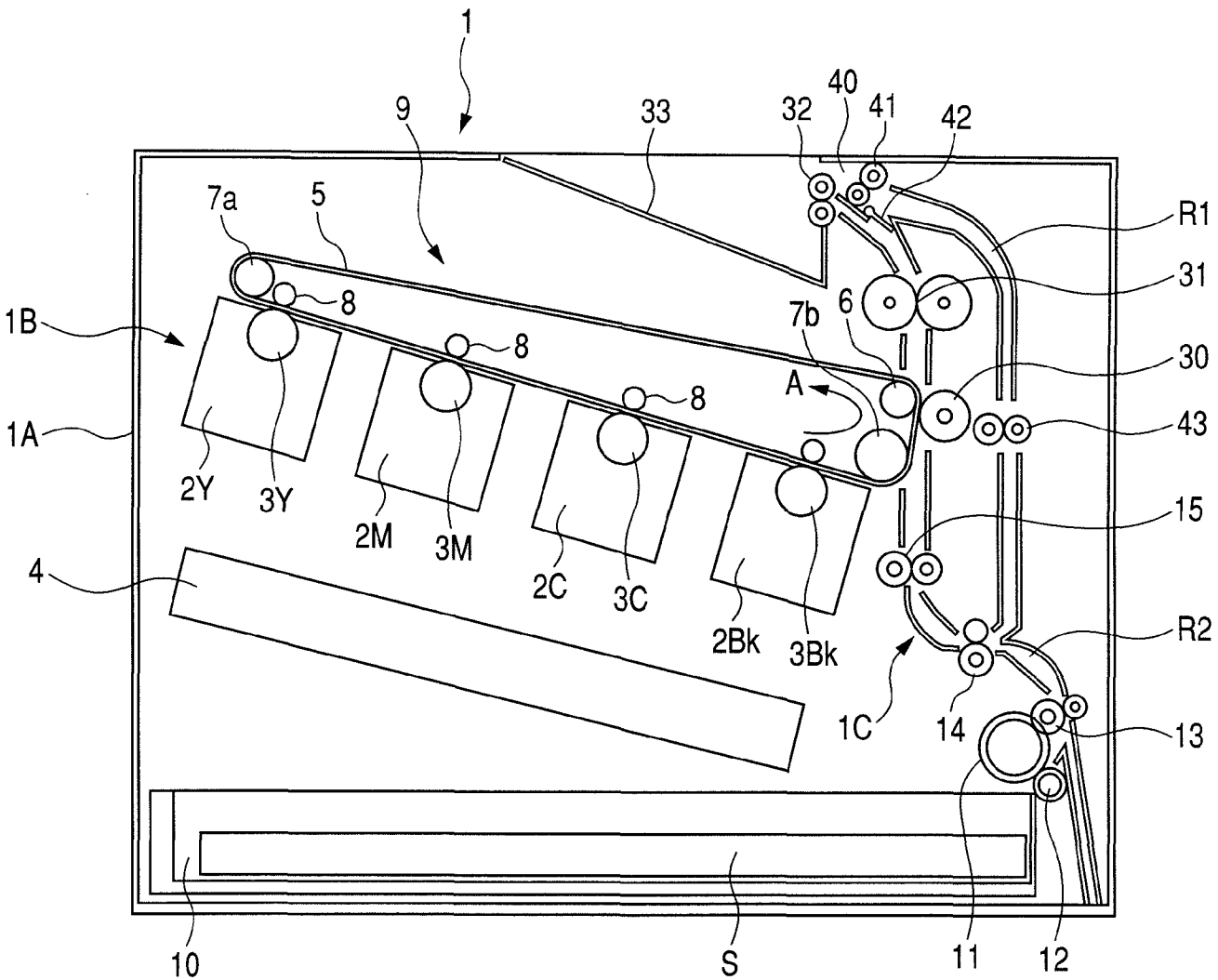
FIG. 1 illustrates a structure of a full-color laser beam printer which is an example of an image forming apparatus including a sheet conveying apparatus according to the present invention.

FIG. 1 illustrates a structure of a full-color laser beam printer which is an example of an image forming apparatus including a sheet conveying apparatus according to the present invention. A full-color laser beam printer 1 includes a full-color laser beam printer main body 1A (hereinafter, referred to as printer main body), an image forming portion 1B for forming an image on a sheet, a sheet conveying apparatus 1C, and a fixing unit 31.

The image forming portion 1B includes a scanner unit 4 and four process cartridges 2 (2Y, 2M, 2C, and 2Bk) for forming a toner image of four colors including yellow (Y), magenta (M), cyan (C), and black (Bk). The image forming portion 1B includes an intermediate transferring unit 9 provided above the process cartridges 2.

Each of the process cartridges 2 include photosensitive drums 3 (3Y, 3M, 3C, and 3Bk) serving as image bearing members for forming toner images. Each of the photosensitive drums 3 is rotatably supported at both ends thereof by a support member, thereby rotating clockwise by transmitting a driving force from a drive motor (not shown) to one of the ends.

The intermediate transferring unit 9 includes an intermediate transferring belt 5 winded around a drive roller 6, a tension roller 7*a*, and a driven roller 7*b*. The intermediate transferring unit 9 includes primary transferring rollers 8 which are provided on an inner side of the intermediate transferring belt 5 and which abut on the intermediate transferring belt 5 at positions opposed to the photosensitive drums 3.

The intermediate transferring belt 5 is formed of a film-like member, is disposed so as to be brought into contact with each of the photosensitive drums 3, and rotates in an arrow direction (counter clockwise) by the drive roller 6 driven by a drive portion (not shown). By applying a positive transfer bias to the intermediate transferring belt 5 by the primary transferring rollers 8, the toner images of each color having a negative polarity on the photosensitive drums are successively transferred in multi layers onto the intermediate transferring belt 5. As a result, a full-color image is formed on the intermediate transferring belt.

At a position opposing to the drive roller 6 on the intermediate transferring unit 9, there is provided a secondary transferring roller 30 constituting a secondary transferring portion for transferring the full-color image formed on the intermediate transferring belt on to a sheet S. The sheet conveying apparatus 1C conveys the sheet to the secondary transferring portion.

A fixing unit 31 is disposed above the secondary transferring roller 30, and a delivery roller pair 32 and a two-side reversing portion 40 are arranged above the fixing unit 31. The two-side reversing portion 40 includes a reversing roller pair 41 serving as a sheet reversing conveying roller which can rotate forward and backward, and a switching member 42. The sheet reversed by the two-side reversing portion 40 is conveyed again by the sheet conveying apparatus 1C to the secondary transferring portion.

In FIG. 1, a re-conveying path R1 is a sheet conveying path which again introduces the sheet reversed front and back surfaces to the image forming portion 1B for forming an image on the back surface (second surface) of the sheet having an image formed on one surface (first surface) thereof by the image forming portion 1B. The re-conveying path R1 is provided with a re-feed roller pair 43 constituting the sheet conveying apparatus 1C.

Next, an image forming operation of the full-color laser beam printer 1 will be described.

When the image forming operation is started, the scanner unit 4 first applies a laser beam (not shown) based on image information from a personal computer or the like (not shown). And surfaces of the photosensitive drums 3 which are uniformly charged to have a predetermined polarity and potential are sequentially exposed, thereby forming electrostatic latent images on the photosensitive drums 3. After that, the electrostatic latent images are developed by toner to be visualized.

For example, a laser beam in response to an image signal for a yellow component color is first applied to the photosensitive drum 3Y from the scanner unit 4. A yellow electrostatic latent image is thereby formed on the photosensitive drum 3Y. The yellow electrostatic latent image is developed by a yellow toner from a developer to be visualized as a yellow toner image.

Next, when the toner image reaches, by rotation of the photosensitive drum 3Y, a primary transferring portion in which the photosensitive drum 3Y and the intermediate transferring belt 5 abuts on each other, owing to a primary transferring bias applied to the primary transferring roller 8, the yellow toner image on the photosensitive drum 3Y is transferred onto the intermediate transferring belt 5.

When a portion of the intermediate transferring belt 5 where the yellow toner image is carried is moved, a magenta toner image which has been previously formed on the photosensitive drum 3M is transferred onto the intermediate transferring belt 5 over the yellow toner image. Similarly, as the intermediate transferring belt 5 is moved, each of a cyan toner image and a black toner image is transferred and superimposed on the yellow toner image and the magenta toner image in primary transferring portions. As a result, a full-color toner image is formed on the intermediate transferring belt.

Simultaneously with the toner image forming operation, sheets S accommodated in a sheet feeding cassette 10 serving as a sheet stacking unit are picked up by a pickup roller 11 serving as a sheet feeding unit. The sheets S are then separated one by one by a separation portion including the pickup roller 11 and a separation roller 12 to be conveyed to a registration roller pair 15 via a conveying roller pair 13 and an intermediate conveying roller pair 14.

At this time, the registration roller pair 15 is stopped. The sheet S is allowed to abut on a nip portion of the stopped registration roller pair 15 to form a loop in the sheet, thereby enabling to correct skew feed of the sheet S.

After correcting the skew feed of the sheet S, the registration roller pair 15 is driven at a timing of aligning the sheet S with respect to the full-color toner image on the intermediate transferring belt in the secondary transferring portion. As a result, the sheet S is conveyed to the secondary transferring portion and the full-color toner image is transferred onto the sheet S at once in the secondary transferring portion by a secondary transferring bias applied to the secondary transferring roller 30.

The sheet S on which the full-color toner image is transferred is conveyed to the fixing unit 31. In the fixing unit 31, all color toners are heated and pressurized to be melted and mixed with each other, and are fixed on the sheet S as a full-color image. After that, the sheet S having the image fixed thereon is delivered to a delivery tray 33 by the delivery roller pair 32 provided downstream of the fixing unit 31.

In a case of forming images on both surfaces of the sheet, first, the switching member 42 of the two-side reversing portion 40 is turned clockwise by a drive mechanism such as a solenoid (not shown) to change the sheet conveying path from the delivery roller pair side to the two-side reversing portion side. As a result, the sheet S having an image formed one surface thereof is introduced to the reversing roller pair 41 and is conveyed by a certain distance by reversing roller pair 41 toward the delivery tray 33.

After the sheet S is conveyed by the certain distance, the reversing roller pair 41 is rotated backward, the sheet S thereby enters the re-conveying path R1 and then reaches a meeting point with a sheet conveying path R2 extending from the pickup roller 11 by the re-feed roller pair 43. After that, the sheet S is conveyed to the secondary transferring portion 30 via the intermediate conveying roller pair 14 and registration roller pair 15, and an image is transferred to the back surface thereof in the secondary transferring portion 30.

By this time, the switching member 42 is switched to a position by which the sheet conveying path is switched to the delivery roller pair 32 side as illustrated in FIG. 1. As a result, the sheet S having the image fixed on the back surface thereof by the fixing unit 31 is stacked on the delivery tray 33 via the delivery roller pair 32.

Figure 2:
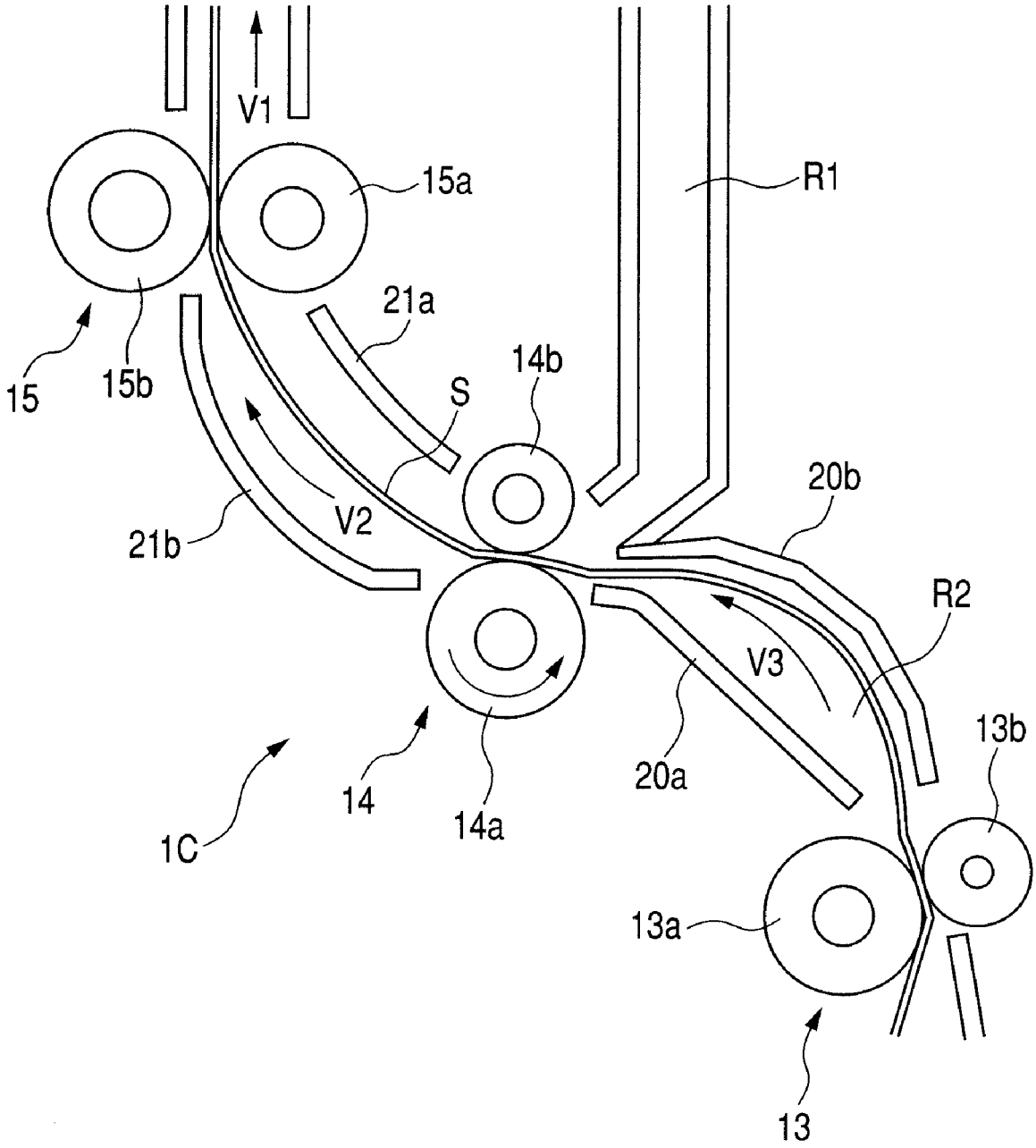
FIG. 2 illustrates a structure of the sheet conveying apparatus.

A structure of the sheet conveying apparatus 1C is illustrated in FIG. 2. As illustrated in FIG. 2, the registration roller pair 15 serving as a first sheet conveying unit includes a drive roller 15*a* and a driven roller 15*b*. The intermediate conveying roller pair 14 serving as a second sheet conveying unit provided upstream in a sheet conveying direction of the registration roller pair 15 includes a drive roller 14*a* and a driven roller 14*b*. The conveying roller pair 13 serving as a third sheet conveying unit provided upstream in the sheet conveying direction of the intermediate conveying roller pair 14 includes a drive roller 13*a* and a driven roller 13*b*.

As illustrated in FIG. 2, between the registration roller pair 15 and the intermediate conveying roller pair 14, there are arranged a pre-registration inner guide 21*a* which serves as a first guide member and a pre-registration outer guide 21*b* which is opposed to the pre-registration inner guide 21*a* and serves as a second guide member. The pre-registration inner guide 21*a* and the pre-registration outer guide 21*b* form a curved sheet conveying path. The pre-registration outer guide 21*b* abuts on the sheet conveyed from the intermediate conveying roller pair 14 and has a circular arc shape. Since the pre-registration outer guide 21*b* has the circular arc shape, the sheet S is guided to the registration roller pair 15 while being curved.

Between the intermediate conveying roller pair 14 and the conveying roller pair 13, there are arranged an intermediate conveying inner guide 20*a* serving as a third guide member and an intermediate conveying outer guide 20*b* serving as a fourth guide member opposed to the intermediate conveying inner guide 20*a*. The intermediate conveying inner guide 20*a* and the intermediate conveying outer guide 20*b* form a curved sheet conveying path. The intermediate conveying outer guide 20*b* abuts on the sheet conveyed from the conveying roller pair 13 and has a circular arc shape. By forming the intermediate conveying outer guide 20*b* in the circular arc shape, the sheet S is guided to the intermediate conveying roller pair 14 while being curved.

In FIG. 2, the sheet conveying velocity of the registration roller pair 15 is set to the V1, the sheet conveying velocity of the intermediate conveying roller pair 14 is set to the V2, and the sheet conveying velocity of the conveying roller pair 13 is set to the V3. In this embodiment, the sheet conveying velocities of the roller pairs 13 to 15 have a relationship of V3>V1>V2. Each of the sheet conveying velocity V1 of the registration roller pair 15, the sheet conveying velocity V2 of the intermediate conveying roller pair 14, and the sheet conveying velocity V3 of the conveying roller pair 13 refers to a peripheral speed of each of the roller pairs.

Even when, the sheet conveying velocity V1 of the registration roller pair 15, the sheet conveying velocity V2 of the intermediate conveying roller pair 14, and the sheet conveying velocity V3 of the conveying roller pair 13 are set so as to establish the above-mentioned relationship, there is a risk in that velocities (actual sheet conveying velocity) at which the sheet itself is actually conveyed do not follow the relationship set as described above. One reason for this risk is thought that, in a case where the sheet is conveyed by being sandwiched by multiple roller pairs, based on a difference between conveying forces of the conveying roller pairs, the sheet is pushed into the conveying roller pair due to stiffness of the sheet. In this embodiment, the actual sheet conveying velocity at a portion where the sheet comes out from the intermediate conveying roller pair 14 is equal to or lower than the sheet conveying velocity V1 of the registration roller pair 15 with reliability. This is realized by achieving the following structure.

A peripheral speed ratio between the sheet conveying velocity V1 of the registration roller pair 15, the sheet conveying velocity V2 of the intermediate conveying roller pair 14, and the sheet conveying velocity V3 of the conveying roller pair 13 is set such that, when the sheet conveying velocity V1 is 100%, the sheet conveying velocity V2 is 99.1% and the sheet conveying velocity V3 is 100.9%. The peripheral speeds do not cause a peripheral speed difference therebetween due to the driving because the conveying roller pairs are driven by the same drive source. Also when the roller diameter varies due to tolerance or wear of the roller diameter, the relationship of V3>V1>V2 can be maintained. The intermediate conveying outer guide 20*b* disposed between the intermediate conveying roller pair 14 and the conveying roller pair 13 has a structure in which, even when a loop is formed in the sheet between the intermediate conveying roller pair 14 and the conveying roller pair 13, the loop portion of the sheet S is not brought into contact with the intermediate conveying outer guide 20*b*. Accordingly, a pushing force into the intermediate conveying roller pair 14 is not caused because the loop portion of the sheet S generated based on the velocity relationship between the V2 and the V3 abuts on the intermediate conveying outer guide 20*b*, thereby regulating grow of the loop by the intermediate conveying outer guide 20*b*.

In each of the conveying roller pairs, rollers are allowed to pressure contact on each other by a compression spring. A conveying force of each of the roller pairs is determined based on a spring pressure of the compression spring or a coefficient of friction on roller peripheral surfaces. In this embodiment, a conveying force F1 of the registration roller pair 15, a conveying force F2 of the intermediate conveying roller pair 14, and a conveying force F3 of the conveying roller pair 13 have a relationship of F1>F2>F3. In addition, the conveying force of the roller pair is in proportion to the spring pressure of the compression spring if the structure of the roller pair is the same.

In the case where a loop is formed in the sheet S between the intermediate conveying roller pair 14 and the conveying roller pair 13, due to generating the loop, there is generated such a force that pushes the sheet S into the intermediate conveying roller pair 14 and the conveying roller pair 13 by the stiffness of the sheet S. In this case, the conveying force of the conveying roller pair 13 is smaller than the conveying force of the intermediate conveying roller pair 14, so slip of the sheet is occurred at the conveying roller pair 13 and slip of the sheet is not caused by the intermediate conveying roller pair 14. Accordingly, the actual sheet conveying velocity at a portion where the sheet comes out from the intermediate conveying roller pair 14 is equal to or lower than the sheet conveying velocity V1 of the registration roller pair 15 with reliability.

Next, a description will be made of a behavior of the sheet S in the case where the sheet conveying velocities of the roller pairs 13 to 15 are set as described above.

First, a behavior of the sheet S between the conveying roller pair 13 and the intermediate conveying roller pair 14 will be described.

When the sheet S is conveyed by the pickup roller 11, the sheet S is conveyed to the nip portion of the conveying roller pair 13 and is conveyed by the conveying roller pair 13 at the sheet conveying velocity V3 of the conveying roller pair 13. After that, when the sheet S is conveyed to the nip portion of the intermediate conveying roller pair 14 while being curved along the curved intermediate conveying outer guide 20*b* by the conveying roller pair 13, the conveying velocity at a leading end of the sheet S becomes the sheet conveying velocity V2 of the intermediate conveying roller pair 14.

At this time point, a part of the sheet S is still nipped by the conveying roller pair 13. Accordingly, due to the relationship of V2<V3, a loop is formed in the sheet S between the conveying roller pair 13 and the intermediate conveying roller pair 14, an amount of the loop being proportional to the conveying distance of the sheet S.

The intermediate conveying outer guide 20*b* forming the sheet conveying path between the conveying roller pair 13 and the intermediate conveying roller pair 14 has an outwardly bulged shape, so the sheet is looped to the intermediate conveying outer guide 20*b* side, the loop becoming larger in proportion to the conveying distance of the sheet.

After that, when the sheet S, which has been conveyed by the intermediate conveying roller pair 14 at the conveying velocity V2, is conveyed to the nip portion of the registration roller pair 15, conveying velocity at the leading end of the sheet S becomes the sheet conveying velocity V1 of the registration roller pair 15.

At this time point, a part of the sheet S is still nipped by the intermediate conveying roller pair 14. A portion of the sheet upstream of the conveying roller pair 13 is also positioned in the separation portion. Accordingly, due to the relationship of V1>V2, that is, due to a difference in sheet conveying velocity between the registration roller pair 15 and the intermediate conveying roller pair 14, the sheet S is pulled between the registration roller pair 15 and the intermediate conveying roller pair 14.

Due to the conveying direction of the intermediate conveying roller pair 14 and the outwardly bulged shape of the pre-registration outer guide 21*b*, the sheet S first abuts on the pre-registration outer guide 21*b* before being nipped by the registration roller pair 15. And then, the sheet S moves along the pre-registration outer guide 21*b*. Since the sheet S is moved in this manner, when the sheet S is nipped by the registration roller pair 15, a loop is generated in the sheet S.

Figure 3B:
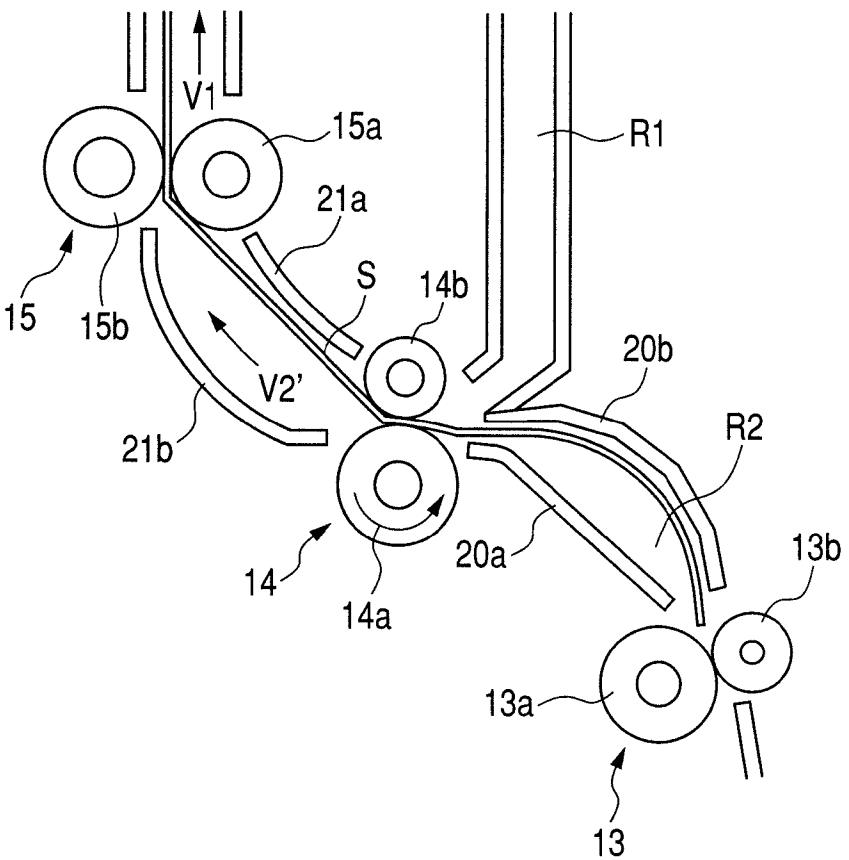
FIGS. 3A and 3B each illustrate a sheet conveying operation of the sheet conveying apparatus.
Figure 3A:
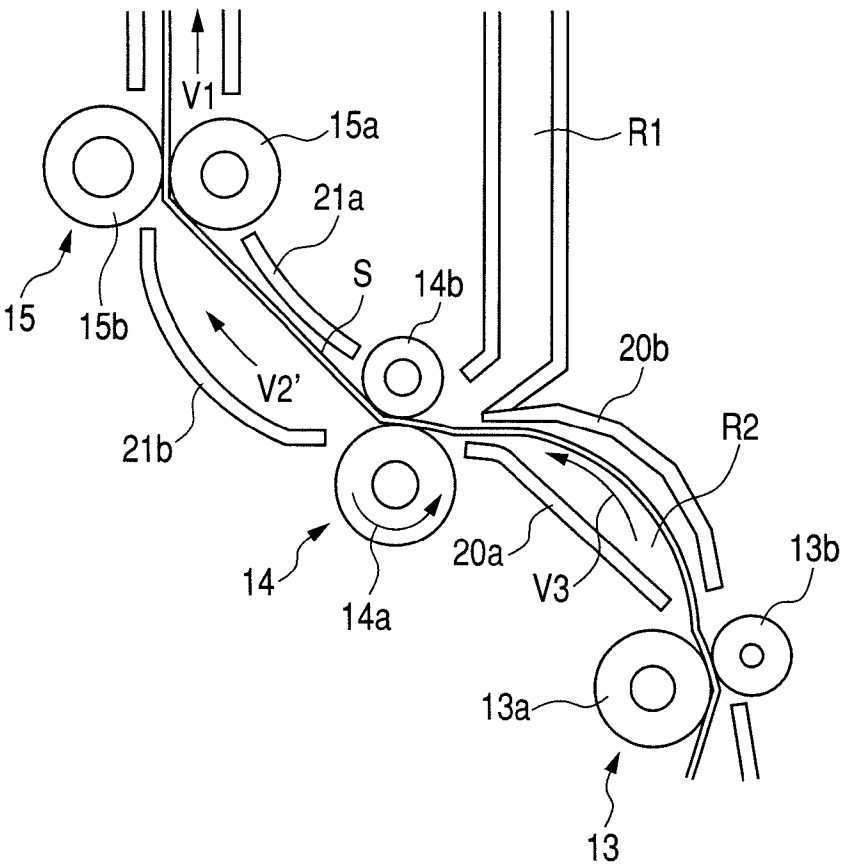

Accordingly, when the sheet S is pulled between the registration roller pair 15 and the intermediate conveying roller pair 14, the sheet is conveyed by the registration roller pair 15 to the secondary transferring portion 30 at the sheet conveying velocity V1 with the loop between the registration roller pair 15 and the intermediate conveying roller pair 14 being reduced. After a while, as illustrated in FIG. 3A, the loop is eliminated between the registration roller pair 15 and the intermediate conveying roller pair 14, and the sheet is pulled straightly.

When the sheet is pulled straightly, the conveying force of the registration roller pair 15 is larger than the conveying force F2 of the intermediate conveying roller pair 14, so the sheet conveying velocity V1 of the registration roller pair 15 remains constant.

In this case, the actual sheet conveying velocity at a portion of the intermediate conveying roller pair 14 is V2'. The sheet is pulled by the registration roller pair 15 having the larger conveying force, thereby making the actual sheet conveying velocity V2' at the intermediate conveying roller pair 14 equal to the sheet conveying velocity V1 of the registration roller pair 15. That is, a relationship of V2'=V1 is established.

On the other hand, a relationship between the sheet conveying velocities of the registration roller pair 15 and the conveying roller pair 13 is V3>V1. Accordingly, when the sheet S is pulled between the registration roller pair 15 and the intermediate conveying roller pair 14, due to a relationship of V3>V1(=V2'), as illustrated in FIG. 3B, the loop of the sheet S between the intermediate conveying roller pair 14 and the conveying roller pair 13 becomes larger in proportion to the conveying distance of the sheet.

That is, when the registration roller pair 15 straightly pulls the sheet S, the sheet conveying velocity of the intermediate conveying roller pair 14 becomes V1(=V2'), and due to the relationship of V3>V1, the loop of the sheet is generated between the conveying roller pair 13 and the intermediate conveying roller pair 14.

The sheet is looped between the conveying roller pair 13 and the intermediate conveying roller pair 14, that is, upstream of the registration roller pair 15, the registration roller pair 15 is not affected by the separation portion serving as a conveying resistance, which is positioned upstream of the loop portion of the sheet. As a result, the registration roller pair 15 can convey the sheet S to the secondary transferring portion 30 at the constant sheet conveying velocity V1.

As described above, before the sheet S is nipped by the registration roller pair 15, a loop is generated in the sheet S due to the conveying direction of the intermediate conveying roller pair 14 and the shape of the pre-registration outer guide 21*b*. After the sheet S is nipped by the registration roller pair 15, in an early stage of the sheet conveyance by the registration roller pair 15, the registration roller pair 15 conveys the sheet S while reducing the loop thereof.

As described above, when the sheet is conveyed by the registration roller pair 15, the conveying roller pair 13, and the intermediate conveying roller pair 14, the actual sheet conveying velocity at a portion of the sheet, which comes out from the intermediate conveying roller pair 14 becomes equal to or lower than the sheet conveying velocity V1 of the registration roller pair 15 with reliability. Accordingly, pushing in of the sheet into the registration roller pair 15 is prevented with reliability. Therefore, the actual sheet conveying velocity at a portion of the sheet downstream of the registration roller pair 15 can be the constant velocity (V1).

When the sheet S is conveyed with the loop thereof being reduced, the registration roller pair 15 can convey the sheet S to the secondary transferring portion 30 while keeping the constant sheet conveying velocity V1. As a result, image expansion and contraction, color drift, or the like due to change in sheet conveying velocity can be prevented from occurring.

Even in a case of a sheet such as a cardboard having high stiffness (high rigidity) in which a loop is hardly formed, since the intermediate conveying outer guide 20*b* and the pre-registration outer guide 21*b* are curved, a loop is easily formed. Even in the sheet such as a cardboard, the loop can be formed easily, so the sheet such as the cardboard can be prevented from being pushed into the registration roller pair 15 due to the stiffness thereof. As a result, even the sheet such as a cardboard can be conveyed to the secondary transferring portion 30 at the stable sheet conveying velocity V1.

Upstream of the registration roller pair 15 and between the intermediate conveying roller pair 14 and the conveying roller pair 13, a loop is formed in the sheet. As a result, back tension by the separation portion is not applied to the registration roller pair 15 as a force applied thereto. As a result, roller wear can be reduced, and even when the number of sheets to be passed is increased, the sheet S can be continuously conveyed to the secondary transferring portion 30 at the constant sheet conveying velocity V1.

The pre-registration inner guide 21*a* is disposed by having a shape having smaller curvature so as not to be brought into contact with the sheet S as illustrated in FIG. 3A even in a case where the sheet S is straightly pulled between the registration roller pair 15 and the intermediate conveying roller pair 14. With this structure, a resistance caused by sliding between the sheet S and the pre-registration inner guide 21*a* is eliminated.

Due to the difference between the sheet conveying velocities, between the conveying roller pair 13 and the intermediate conveying roller pair 14, a loop of the sheet is generated. The relationship between the sheet conveying velocities V3 and V2 is set such that the loop is not brought into contact with the intermediate conveying outer guide 20*b*. The relationship between the sheet conveying velocities V3 and V1 is set such that, even in a case where the loop is made larger, before the loop is brought into contact with the intermediate conveying outer guide 20*b*, the sheet S passes through the conveying roller pair 13 as illustrated in FIG. 3B.

By setting the sheet conveying velocities V1 to V3 as described above, the sheet S can be prevented from being brought into contact with the pre-registration inner guide 21*a* and the intermediate conveying outer guide 20*b*. As a result, a resistance caused by the sheet S being brought into contact with the pre-registration inner guide 21*a* and the intermediate conveying outer guide 20*b* is eliminated.

In this embodiment, the sheet conveying velocity V3 of the conveying roller pair 13 is the fastest, so back tension caused between the pickup roller 11 and the separation roller 12 can be absorbed. As a result, an effect of a feeding portion on the sheet conveying velocity V1 of the registration roller pair 15 can be eliminated.

As described above, a relationship of the sheet conveying velocities of the roller pairs 13 to 15 is V3>V1>V2. Accordingly, when the sheet S is conveyed by the registration roller pair 15, a loop can be formed always upstream of the sheet registration roller pair 15. That is, when the sheet S is conveyed by the registration roller pair 15, the conveying velocities of the roller pairs 13 to 15 are set such that the loop is formed in the sheet upstream of the registration roller pair 15, whereby the sheet can be continuously conveyed at the stable sheet conveying velocity. The actual sheet conveying velocity of the portion of the sheet ejected from the intermediate conveying roller pair does not exceed the velocity of the registration roller pair 15, so the pushing in of the sheet into the registration roller pair 15 does not occur.

In the above-mentioned embodiment, by setting the conveying forces of the conveying roller pairs so as to establish a relationship of F1>F2>F3, the actual conveying velocity of the sheet at the portion where the sheet comes out from the intermediate conveying roller pair 14 when the sheet is conveyed by the intermediate conveying roller pair 14 and the conveying roller pair 13 does not exceed the sheet conveying velocity V1 of the registration roller pair 15 with reliability. However, this effect can also be realized by the following structure.

A peripheral velocity ratio between the sheet conveying velocity V1 of the registration roller pair 15, the sheet conveying velocity V2 of the intermediate conveying roller pair 14, and the sheet conveying velocity V3 of the conveying roller pair 13 is set such that, when the sheet conveying velocity V1 is 100%, the sheet conveying velocity V2 is 99.1% and the sheet conveying velocity V3 is 100.9%. All the roller pairs are driven by the same drive source, so in the peripheral speed relationship, there is not caused a peripheral velocity difference by the driving. Even when the roller diameter is changed by tolerance of the roller diameter or wear, the relationship of V3>V1>V2 can be retained. The intermediate conveying outer guide 20*b* disposed between the intermediate conveying roller pair 14 and the conveying roller pair 13 has a structure in which, even when a loop is formed in the sheet S between the intermediate conveying roller pair 14 and the conveying roller pair 13, the loop portion of the sheet S is not brought into contact with the intermediate conveying outer guide 20*b*. Accordingly, the loop in the sheet S caused with the velocity relationship is not brought into contact with the outer intermediate conveying guide 20*b*, and the pushing force into the intermediate conveying roller pair 14 is not caused.

The drive roller 14*a* of the intermediate conveying roller pair 14 includes a ratchet mechanism. The ratchet mechanism has a structure which transmits a drive force to the drive roller 14*a* only in a counter clockwise direction (arrow direction of the figure) from a drive train. The ratchet mechanism is provided with a compression spring. A spring pressure of the compression spring is set, with the relationship between the conveying velocities of the conveying roller pairs, such that the spring pressure acts against the pushing force due to the stiffness of the loop of the sheet caused by the difference in conveying velocity between the intermediate conveying roller pair 14 and the conveying roller pair 13. On the other hand, the spring pressure of the compression spring of the ratchet mechanism is set to a spring pressure which allows the intermediate conveying roller pair 14 to rotate by a tensile force of the sheet due to the difference in conveying velocity between the registration roller pair 15 and the intermediate conveying roller pair 14. With this structure, the same effect as that of the above embodiment can be obtained.

Hereinabove, the description is made of the conveying velocity control of the sheet conveying apparatus 1C in the case where an image is formed on a first surface of the sheet. However, in this embodiment, the above-mentioned conveying velocity control is also applied to a portion where the sheet is conveyed in the case where images are formed on both surfaces of the sheet. Next, a description will be made of sheet conveyance in the re-conveying path used in the case where images are formed on both surfaces of the sheet with reference to FIGS. 4 to 6B.

Figure 4:
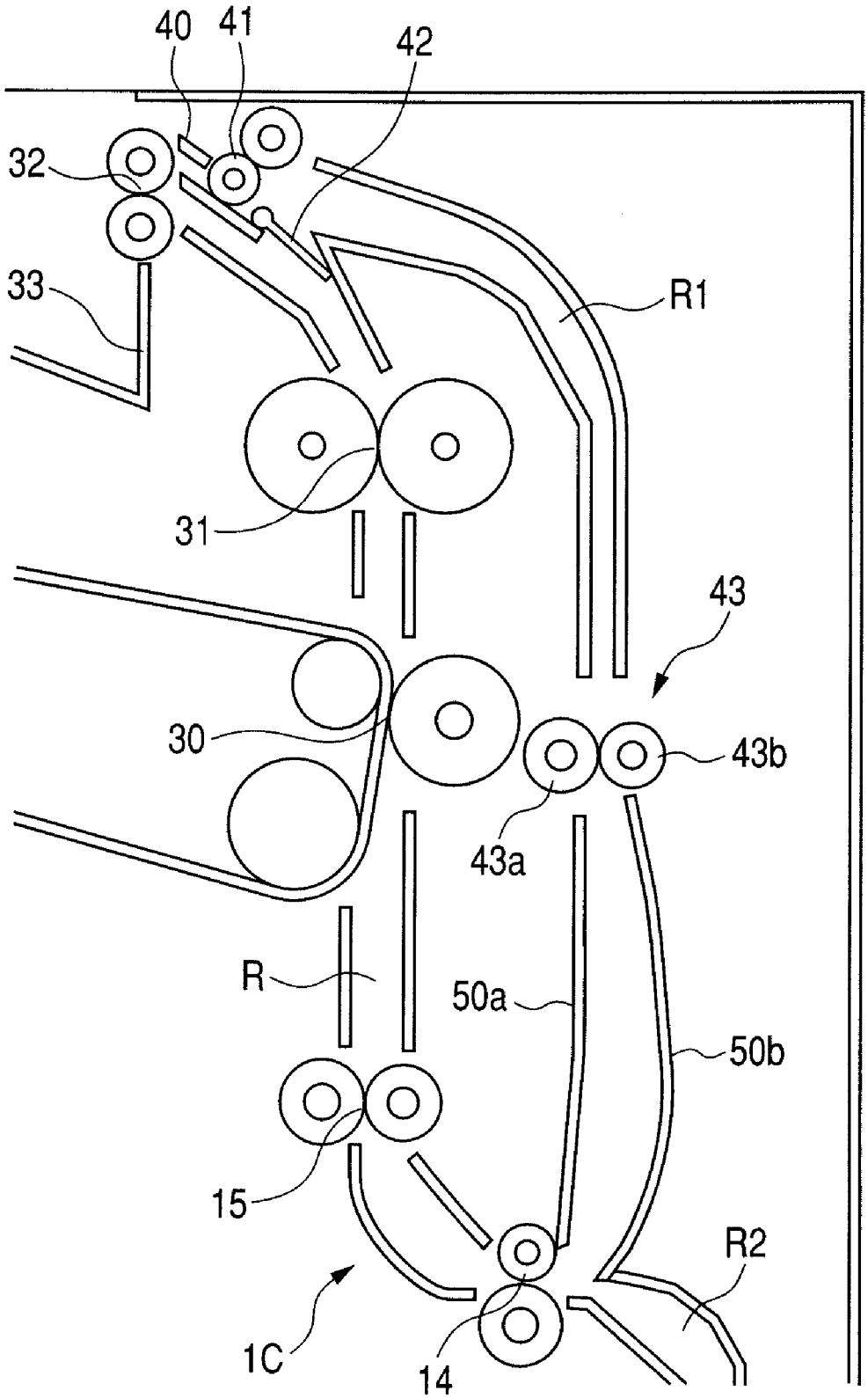
FIG. 4 illustrates a structure of a sheet conveying apparatus provided to an image forming apparatus according to the present invention.

In FIG. 4, a re-feed inner guide 50*a* serving as a third guide member and an re-feed outer guide 50*b* serving as a fourth guide member forms a portion of the re-conveying path R1 vertically extending between the intermediate conveying roller pair 14 and the re-feed roller pair 43.

By a sheet conveying path R for conveying the sheet to the secondary transferring portion 30 and a re-conveying path R1, a conveying path between the re-feed roller pair 43 and the registration roller pair 15 is formed in a U shape. The re-feed roller pair 43 serving as a third sheet conveying unit for conveying the reversed sheet S again to the secondary transferring portion includes a drive roller 43*a* and a driven roller 43*b*.

The re-feed outer guide 50*b* having an outwardly bulged circular arc shape abuts on the sheet conveyed from the re-feed roller pair 43, the sheet having an image formed on one surface thereof as described above and being then reversed by the two-side reversing portion 40. By forming the re-feed outer guide 50*b* in the outwardly bulged circular arc shape, the sheet S is guided to the re-feed roller pair 43 while being curved.

Figure 5:
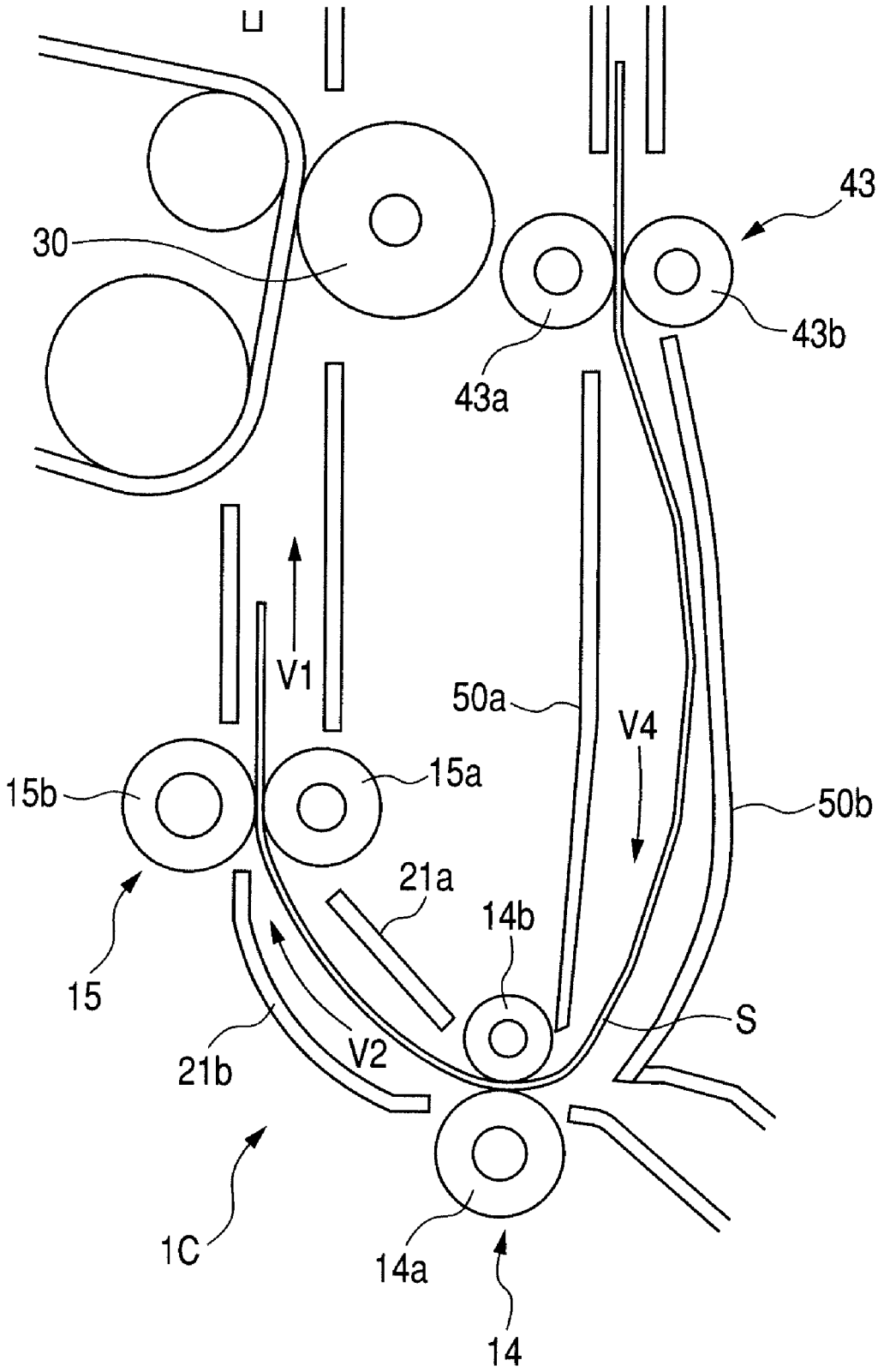
FIG. 5 illustrates a sheet conveying operation of the sheet conveying apparatus.

FIG. 5 illustrates a state where, after the sheet S having an image formed on one surface thereof is allowed to reach, by the re-feed roller pair 43, a meeting point with the sheet conveying path R2 extending from the pickup roller 11, the sheet S is conveyed to the intermediate conveying roller pair 14 and the registration roller pair 15.

In FIG. 5, a sheet conveying velocity of the re-feed roller pair 43 is V4. In this embodiment, the sheet conveying velocity V4 of the re-feed roller pair 43, the sheet conveying velocity V1 of the registration roller pair 15, and the sheet conveying velocity V2 of the intermediate conveying roller pair 14 have a relationship of V4>V1>V2.

A nip force of each of the conveying roller pairs is imparted by a compression spring (not shown). The conveying force F1 of the registration roller pair 15, the conveying force F2 of the intermediate conveying roller pair 14, and a conveying force F4 of the re-feed roller pair 43 have a relationship of F1>F2>F4.

In the case where the sheet S is looped owing to a velocity difference between the re-feed roller pair 43 and the intermediate conveying roller pair 14, there is generated, by stiffness of the sheet, such a force that pushes the sheet into the re-feed roller pair 43 and the intermediate conveying roller pair 14. In this case, the conveying force of the re-feed roller pair 43 is smaller than the conveying force of the intermediate conveying roller pair, so the sheet is pushed into the re-feed roller pair 43 side. The pushing in of the sheet into the intermediate conveying roller pair 14 side is not caused, so the actual conveying velocity of a portion of the sheet, which comes out from the intermediate conveying roller pair 14 is equal to or lower than the sheet conveying velocity V1 of the registration roller pair 15.

A behavior of the sheet S in the case where the sheet conveying velocities of the roller pairs 14, 15, and 43 will be described.

In order to form images on both surfaces, when the sheet S is conveyed to the nip portion of the re-feed roller pair 43 from the two-side reversing roller pair 41, the conveying velocity of the sheet S becomes the sheet conveying velocity V4 of the re-feed roller pair 43. After that, when the re-feed roller pair 43 conveys the sheet S to the nip portion of the intermediate conveying roller pair 14, the conveying velocity at the leading end of the sheet S becomes the sheet conveying velocity V2 of the intermediate conveying roller pair 14.

At this time point, a part of the sheet S is nipped by the re-feed roller pair 43, due to the relationship of V2<V4, between the re-feed roller pair 43 and the intermediate conveying roller pair 14, in the sheet S, a loop is formed on the re-feed outer guide side, an amount of the loop being proportional to the conveyed distance.

Next, when the sheet S conveyed by the intermediate conveying roller pair 14 at the sheet conveying velocity V2 is conveyed to the nip portion of the registration roller pair 15, the leading end of the sheet S is conveyed by the registration roller pair 15 at the sheet conveying velocity V1.

Figure 6B:
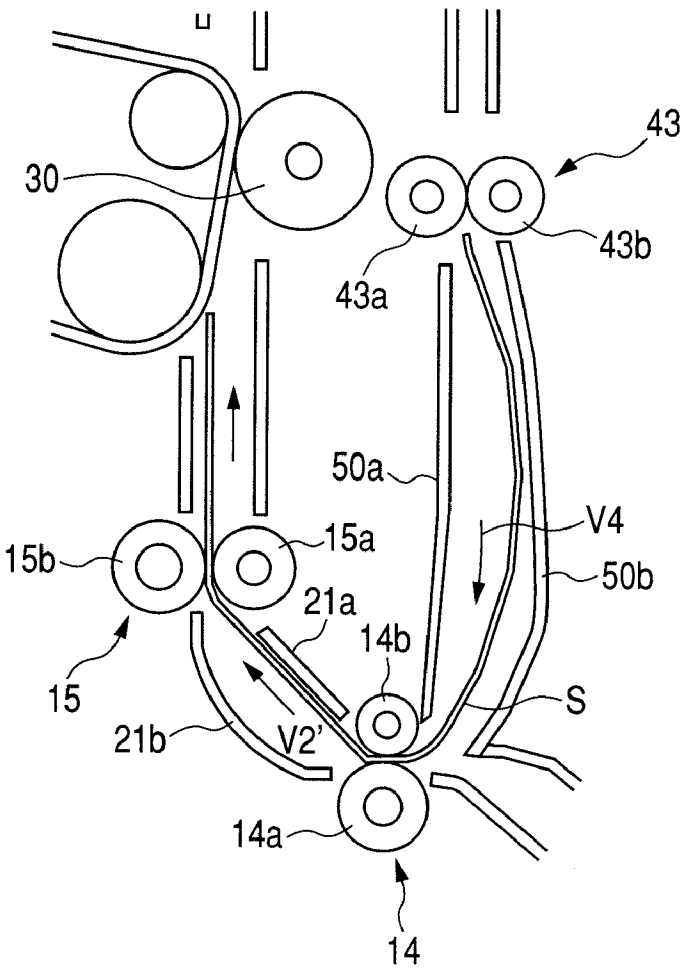
FIGS. 6A and 6B each illustrate a sheet conveying operation of the sheet conveying apparatus.
Figure 6A:
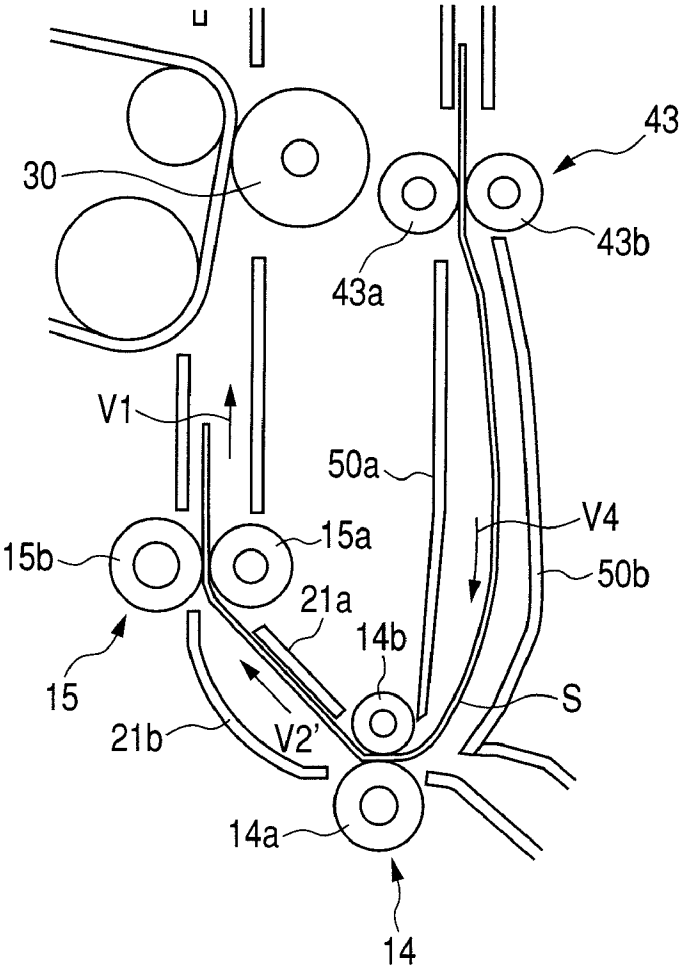
Figure 7:
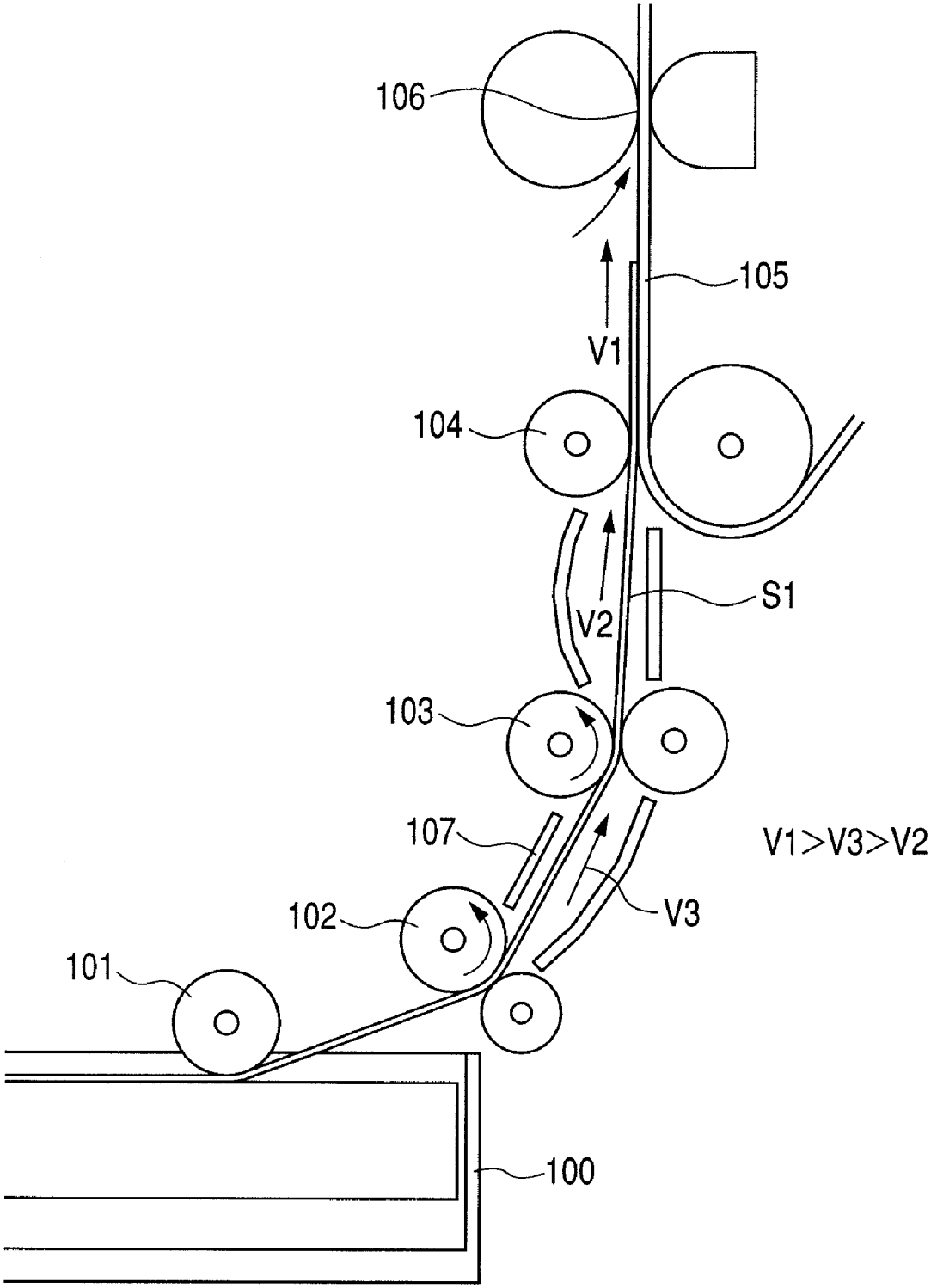
FIG. 7 illustrates a structure of a conventional sheet conveying apparatus.

At this time point, a part of the sheet S is nipped by the intermediate conveying roller pair 14. Accordingly, due to the relationship of V1>V2, the sheet S between the registration roller pair 15 and the intermediate conveying roller pair 14 is pulled straightly as illustrated in FIG. 6A. When the sheet S is pulled straightly, the conveying force of the registration roller pair 15 is larger than the conveying force F2 of the intermediate conveying roller pair 14, so the sheet conveying velocity V1 of the registration roller pair 15 remains constant.

The actual sheet conveying velocity at the portion of the intermediate conveying roller pair 14 is V2'. The sheet is pulled by the registration roller pair 15 having the larger conveying force, thereby making the actual sheet conveying velocity V2' at the intermediate conveying roller pair 14 equal to the sheet conveying velocity V1 of the registration roller pair 15. That is, a relationship of V2'=V1 is established.

On the other hand, a relationship between sheet conveying velocities of the registration roller pair 15 and the re-feed roller pair 43 is V4>V1. Accordingly, when the sheet S is pulled between the registration roller pair 15 and the intermediate conveying roller pair 14, due to the relationship of V4>V1(=V2'), the loop in the sheet S between the intermediate conveying roller pair 14 and the re-feed roller pair 43 becomes larger in proportion to the conveyed distance as illustrated in FIG. 6B.

That is, when the registration roller pair 15 pulls the sheet S straightly, the sheet conveying velocity of the intermediate conveying roller pair 14 becomes the V1(=V2'), and due to the relationship of V4>V1, a loop in the sheet is generated between the re-feed roller pair 43 and the intermediate conveying roller pair 14.

When the sheet is looped between the re-feed roller pair 43 and the intermediate conveying roller pair 14, that is, upstream of the registration roller pair 15, the registration roller pair 15 is not affected by a conveying resistance or the like. As a result, the registration roller pair 15 can convey the sheet S to the secondary transferring portion 30 at the constant sheet conveying velocity V1.

The conveying velocities V4 and V2, which cause the loop of the sheet to be formed between the re-feed roller pair 43 and the intermediate conveying roller pair 14 due to the difference between the sheet conveying velocities, are set to such a relationship that the sheet is not brought into contact with the re-feed outer guide 50*b*. The conveying velocities V4 and V1 are set such that, even when the loop is made larger, before the loop is brought into contact with the intermediate conveying outer guide 20*b*, the sheet S passes through the re-feed roller pair 43 as illustrated in FIG. 6B. In other words, the re-feed outer guide 50*b* is provided at a position where the re-feed outer guide 50*b* is not brought into contact with the loop of the sheet even when a loop is formed in the sheet between the re-feed roller pair 43 and the intermediate conveying roller pair 14.

As a result, the sheet S can be prevented from being brought into contact with the re-feed outer guide 50*b* and the pre-registration inner guide 21*a*, and the resistance which causes the sheet S to be brought into contact with the re-feed outer guide 50*b* and the pre-registration inner guide 21*a* can be eliminated. The grow of the loop is regulated by the re-feed outer guide 50*b*, whereby the sheet is not pushed into the intermediate conveying roller pair 14.

Hereinabove, the description is made of the image forming apparatus of a type in which, after the toner images formed on the photosensitive drums 3 are transferred onto the intermediate transferring belt 5, the image is transferred onto the sheet in the secondary transferring portion. However, the present invention is not limited to this. For example, the present invention can also be applied to the image forming apparatus of a type in which the toner images formed on the photosensitive drums 3 are directly transferred onto the sheet in the transferring portion.

Hereinabove, the description is made of the sheet conveying apparatus provided to the image forming apparatus. However, the present invention is not limited to this. For example, the present invention can be applied to an auto document feeder as an example of the sheet conveying apparatus to be used for an image reader or the like, for conveying a document, that is, the sheet to an image reading portion for reading a document image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-095290, filed Mar. 30, 2007, which is hereby incorporated by reference herein in its entirety.

What is claimed is:

1. A sheet conveying apparatus, comprising:

a first sheet conveying rotary member;

a second sheet conveying rotary member provided upstream in a sheet conveying direction of the first sheet conveying rotary member;

a third sheet conveying rotary member provided upstream in the sheet conveying direction of the second sheet conveying rotary member;

wherein the first sheet conveying rotary member, the second sheet conveying rotary member, and the third sheet conveying rotary member can convey the same sheet at the same time;

a driving mechanism configured to drive the first sheet conveying rotary member, the second sheet conveying rotary member and the third sheet conveying rotary member so that a relationship between peripheral speeds V1, V2, and V3 is V3>V1>V2, the V1 is a peripheral speed of the first sheet conveying rotary member, the V2 is a peripheral speed of the second sheet conveying rotary member, and the V3 is a peripheral speed of the third sheet conveying rotary member; and wherein an actual velocity of a sheet at a portion where the sheet is ejected from the second sheet conveying rotary member is equal to or lower than the peripheral speed of the first sheet conveying rotary member.

2. A sheet conveying apparatus according to claim 1, further comprising a guide member which is provided between the second sheet conveying rotary member and the third sheet conveying rotary member and has a curved shape, the guide member guides the sheet to be conveyed by the third sheet conveying rotary member to the second sheet conveying rotary member;

wherein the guide member is provided at a position where the guide member is prevented from being brought into contact with a loop of the sheet even in a case where the sheet is bent between the second sheet conveying rotary member and the third sheet conveying rotary member when the sheet is conveyed by the second sheet conveying rotary member and the third sheet conveying rotary member.

3. A sheet conveying apparatus according to claim 1, wherein, when the actual velocity of the sheet at the portion where the sheet is ejected from the second sheet conveying rotary member coincides with the peripheral speed of the first sheet conveying rotary member due to conveyance of the sheet of the first sheet conveying rotary member, a loop is formed in the sheet at a portion between the second sheet conveying rotary member and the third sheet conveying rotary member.

4. A sheet conveying apparatus according to claim 1, further comprising:

a first rotary member which forms a first nip with the first sheet conveying rotary member; and a second rotary member which forms a second nip with the second sheet conveying rotary member;

wherein a nip line of the second nip is inconsistent with a nip line of the first nip.

5. A sheet conveying apparatus according to claim 1, further comprising:

a second rotary member which constitutes a second sheet conveying unit with the second sheet conveying rotary member; and a third rotary member which constitutes a third sheet conveying unit with the third sheet conveying rotary member;

wherein a conveying force of the second sheet conveying unit is larger than a conveying force of the third sheet conveying unit so that the actual velocity of a sheet at a portion where the sheet is ejected from the second sheet conveying rotary member is equal to or lower than the peripheral speed of the first sheet conveying rotary member.

6. An image forming apparatus, comprising:

an image bearing member on which a toner image is formed;

a transferring portion for transferring the toner image formed on the image bearing member onto a sheet; and the sheet conveying apparatus according to claim 1, for conveying the sheet to the transferring portion.

7. An image forming apparatus according to claim 6, further comprising:

a sheet stacking portion; and a sheet feeding portion for sending out the sheet stacked on the sheet stacking portion;

wherein the first sheet conveying rotary member conveys the sheet to the transferring rotary member so that the sheet is aligned with the toner image on the image bearing member; and the third sheet conveying rotary member delivers to the second sheet conveying rotary member the sheet fed by the sheet feeding portion.

8. An image forming apparatus according to claim 6, further comprising a re-conveying path which reverses the sheet having the toner image transferred onto a first surface thereof by the transferring portion, and conveys again to the transferring portion;

wherein the third sheet conveying rotary member is provided in the re-conveying path and delivers to the second sheet conveying rotary member the sheet having the toner image transferred on the first surface thereof.

9. A sheet conveying apparatus, comprising:

a first sheet conveying rotary member;

a second sheet conveying rotary member provided upstream in a sheet conveying direction of the first sheet conveying rotary member;

a third sheet conveying rotary member provided upstream in the sheet conveying direction of the second sheet conveying rotary member; and a guide member which is provided between the second sheet conveying rotary member and the third sheet conveying rotary member, and the guide member guides the sheet which is conveyed by the third sheet conveying rotary member to the second sheet conveying rotary member;

wherein the first sheet conveying rotary member, the second sheet conveying rotary member, and the third sheet conveying rotary member can convey the same sheet at the same time;

a driving mechanism configured to drive the first sheet conveying rotary member, the second sheet conveying rotary member and the third sheet conveying rotary member so that a relationship between peripheral speeds V1, V2, and V3 is V3>V1>V2, the V1 is a peripheral speed of the first sheet conveying rotary member, the V2 is a peripheral speed of the second sheet conveying rotary member, and the V3 is a peripheral speed of the third sheet conveying rotary member; and the guide member is provided at a position where the guide member is prevented from being brought into contact with a loop of the sheet even in a case where the loop is formed in the sheet between the second sheet conveying rotary member and the third sheet conveying rotary member when the sheet is conveyed by the second sheet conveying rotary member and the third sheet conveying rotary member.

10. An image forming apparatus according to claim 9, wherein the guide member has a curved shape.

* * * * *